US007267161B2

(12) United States Patent
Colasson et al.

(10) Patent No.: US 7,267,161 B2
(45) Date of Patent: Sep. 11, 2007

(54) HEAT EXCHANGER COMPRISING A SUPERCRITICAL CARBON-DIOXIDE CIRCUIT

(75) Inventors: Stéphane Colasson, Veurey-Voroize (FR); Arnaud Bruch, Sainte Colombe (FR)

(73) Assignee: Commissariat a l'Energie Atomique, Paris (FR)

( * ) Notice: Subject to any disclaimer, the term of this patent is extended or adjusted under 35 U.S.C. 154(b) by 0 days.

(21) Appl. No.: 11/503,674

(22) Filed: Aug. 14, 2006

(65) Prior Publication Data

US 2007/0051505 A1 Mar. 8, 2007

(30) Foreign Application Priority Data

Sep. 7, 2005 (FR) ..... 05 52702

(51) Int. Cl.
*F28F 13/12* (2006.01)

(52) U.S. Cl. ..... 165/133; 165/906

(58) Field of Classification Search ..... 165/133, 165/146

See application file for complete search history.

(56) References Cited

U.S. PATENT DOCUMENTS 3,154,141 A * 10/1964 Huet ..... 165/133
3,217,799 A * 11/1965 Rodgers ..... 165/179
3,244,601 A * 4/1966 Diedrich ..... 202/236
3,885,622 A * 5/1975 McLain ..... 165/179
3,902,552 A * 9/1975 McLain ..... 165/179
4,258,783 A * 3/1981 Albertson et al. ..... 165/133
4,809,415 A * 3/1989 Okayama et al. ..... 29/890.048
5,070,937 A * 12/1991 Mougin et al. ..... 165/133
6,644,388 B1 * 11/2003 Kilmer et al. ..... 165/133
2002/0096314 A1 * 7/2002 Liu et al. ..... 165/133

FOREIGN PATENT DOCUMENTS

EP 1 389 721 A1 2/2004
JP 2001-221580 A1 8/2001

OTHER PUBLICATIONS

Zilly, J. et al., "*Condensation of $Co_2$ at Low Temperatures in Micro-Finned Horizontal Tubes*," International Congress of Refrigeration 2003, Washington, DC, Aug. 17, 2003, *Abstract*.

* cited by examiner

*Primary Examiner*—Allen J. Flanigan
(74) *Attorney, Agent, or Firm*—Burr & Brown

(57) ABSTRACT

The invention relates to a heat exchanger comprising a supercritical carbon-dioxide circuit comprising a plurality of tubes (1).

The heat exchanger is original in that at least one section of the tubes (1) have surface irregularities (3) on their inner surface. These irregularities (3) are located within a zone (6) extending as far as a point located at a distance from the inlet (7) of the tube of maximum 400 times the diameter of the tube.

6 Claims, 1 Drawing Sheet

HEAT EXCHANGER COMPRISING A SUPERCRITICAL CARBON-DIOXIDE CIRCUIT

FIELD OF THE INVENTION

The invention relates to the sector of heat or thermal exchangers, more precisely heat exchangers that operate with a high-pressure, carbon-dioxide ($CO_2$) circuit.

The invention more specifically concerns the structure of tubular channels used in such exchangers in order to improve the heat exchange performances.

PRIOR ART

In general, high-pressure fluids are widely used in many installations requiring heat exchange between a fluid circuit and the external environment or between two fluid circuits, whether in cooling or heating installations in both the industrial and domestic sectors.

The use of high operating pressure fluids requires heat exchange structures capable of withstanding high levels of mechanical stress. This stress is particularly found at the inlet and outlet zones of the exchangers where it is necessary to maintain absolute leaktightness.

Similarly, the use of high-pressure fluids requires the use of exchangers consisting of a plurality of tubular channels that may have the smallest possible flow cross section in order to maintain a high level of mechanical resistance.

There is therefore considerable advantage in having exchangers in which heat transfer is particularly high. High heat exchange performances result directly in very compact exchangers and therefore a reduction in the mechanical infrastructure needed to support them.

In particular, one of the high-pressure fluids used in heat exchangers is carbon dioxide ($CO_2$) which is appreciated for the fact that in principle it has no impact on the ozone layer. Carbon dioxide is therefore frequently used in heat exchangers with pressure between 80 and 150 bar, i.e. pressure located above the critical point (73 bar, 31° C.).

Evaluations of certain advantages of supercritical $CO_2$ exchangers are discussed in the following documents:

Bruch, S. Colasson, A. Bontemps, J. F. Fourmigué, 2004, CFD "Approach to supercritical carbon flow in a vertical tube—Comparison of upward and downward flows", *6th International Gustav Lorentzen Conference on Natural Fluids*, Glasgow, Scotland.

Bruch, A. Bontemps, J. F. Fourmigué, S. Colasson, 2005, "Simulation numérique du comportement thermohydraulique d'un écoulement de $CO_2$ supercritique dans un tube vertical" (Numerical simulation of the thermo-hydraulic behaviour of supercritical $CO_2$ flowing in a vertical tube), *Annual congress of the SFT*, Reims, France.

Bruch, A. Bontemps, S. Colasson, J. F. Fourmigué, 2005, "Numerical investigation of laminar convective heat transfer of carbon dioxide flowing in vertical mini tubes in cooling conditions", *International conference on heat transfer in components and systems for sustainable energy technologies*, Grenoble, France.

In general, in order to maintain laminar flow, fluid flow-speeds in the zone around the surfaces may be relatively low, i.e. of the order of 0.1 to 0.3 m/s, causing a marked drop in the coefficient of heat transfer, and thus the performances of the exchanger.

More precisely, evaluations by calculating the coefficient of heat transfer were performed on a $CO_2$ exchanger comprising smooth tubes at various points on the length of the tubes. These evaluations found that the coefficient of heat transfer was relatively high in the tube inlet zone, i.e. practically twice the value measured at the end of the tube. On the other hand, once past the tube inlet zone heat exchange dropped markedly, even dropping below the classic value for laminar flow of a single-phase fluid like water or air that have physical properties that remain constant despite changes in temperature.

The increased coefficient of heat transfer in the tube inlet zone is the combined result of establishing the flow, and more pronounced changes in the physical properties of supercritical carbon dioxide due to high thermal gradients.

The aim of the invention is to improve the heat exchange performances of exchangers using tubes through which supercritical carbon dioxide flows.

DISCLOSURE OF THE INVENTION

The invention thus relates to a heat exchanger comprising a supercritical carbon-dioxide circuit. In ways already known, the circuit comprises a plurality of tubes in which heat exchange takes place.

In the present invention the surfaces of at least some of the tubes comprise irregularities on their inner surfaces.

"Surface irregularities" or "microstructures" present on the inner surface of the tubes is understood to mean any concave or convex distortion of the cylindrical profile of the tube which results in changes in the cross section of the tube along its length.

According to one characteristic of the invention these irregularities are located in a zone that extends from the inlet of the tube up to a point located a maximum 400 times the diameter of the tube.

Put another way, the invention consists in using tubes of which only part of the inner surface interne comprises microstructures that modify the laminar flow of the fluid by breaking up the hydraulic and thermal layers. These irregularities are located in the first part of the tube, up to a limit set at 400 times the diameter of the tube.

The general principle of disturbing the laminar flow of a fluid in order to improve the coefficient of heat transfer must be considered as known. This principle is widely used in various types of tubular heat exchanger, and also in plate heat exchangers. It consists in causing disturbances in flow along the entire length of the exchange zone consisting of the tubular channel.

However, in contradiction to the generally accepted principle, it appears that in supercritical $CO_2$ exchangers the presence of microstructures or irregularities over the entire length of the tubular channel causes no overall improvement in the transfer coefficient. On the contrary, it causes the opposite effect, i.e. deterioration in heat exchange to the point where the transfer coefficient drops by up to several tenths of percent.

Thus one of the chief aspects of the invention consists in using tubes comprising irregularities that do not run their entire length but are limited to certain zones, more particularly in the tube inlet section.

The use of such microstructures solely in a given zone gives a noticeable increase in heat transfer compared with smooth tubes that is typically of the order of more than 10%.

The localized presence of microstructures is also advantageous in hydraulic terms in that since there is no relief in part of the tube, head loss in the tube is reduced.

In practice, the characteristic zone in which the irregularities are located is downstream of a point located 400 times the diameter of the tube, it being understood that the diameter measurement used to establish this point does not include any irregularities. In other words, the diameter used is the greatest diameter of the regular cylinder that can be drawn inside the tube, i.e. that is in contact with the various irregularities. Put another way, if concave zones are created inside a tube, the diameter measured is that of the tube before such zones are created.

Similarly, if convex irregularities are created inside the tube, the diameter measured is that of the tube without irregularities, before the convex zones are created.

The tubes may preferentially be generally cylindrical in shape therefore having a disk-shaped cross-section. However it is also possible to use tubes whose cross-section is not circular but polygonal or elliptical. In this situation the diameter measured to establish the zone in which the microstructures should be located is the hydraulic diameter which is usually defined as the ratio of four times the cross-section of the tube divided by the wetted perimeter, i.e. the length of the perimeter of the cross-section in question.

In a preferred form the irregularities are located in a zone that lies between a point 80 times the diameter and 200 times the diameter of the tube, these distances being measured from the inlet of the tube. The irregularities may occupy all or part of this zone without necessarily extending to the limits given.

Similarly, the choice of this preferential zone means that virtually all the irregularities that have a significant influence on the coefficient of heat transfer are located in this characteristic zone, without however ruling out a much more limited number being present along the length of the tube outside this characteristic zone and therefore having a reduced effect.

In practice, the distribution of the irregularities along the characteristic zone may be uniform or variable along the length of the zone in order to optimise the overall transfer coefficient.

In practice, the irregularities may be created having a variety of shapes and using many different procedures. For example, the irregularities may consist of micro-fins, oriented advantageously and radially along the tube.

They may also consist of recesses hollowed out of the inner surface of the tubular channel. These recesses may be shaped along circumferential grooves in the tube to form micro-undulations.

The profiles of such fins or recesses may be chosen in accordance with conditions of pressure, temperature and the performances required of the exchanger, for example so as not to weaken the tube. These different irregularities may be created in a variety of ways, particularly by machining, milling, extrusion or insertion. The invention can clearly be applied to exchangers made of a variety of materials, in particular stainless steel, aluminium or copper.

BRIEF DESCRIPTION OF THE FIGURES

The way the invention is made and the resulting advantages will be clear from the following description of an embodiment and the attached figures where.

METHOD FOR EMBODYING THE INVENTION

Figure 1:
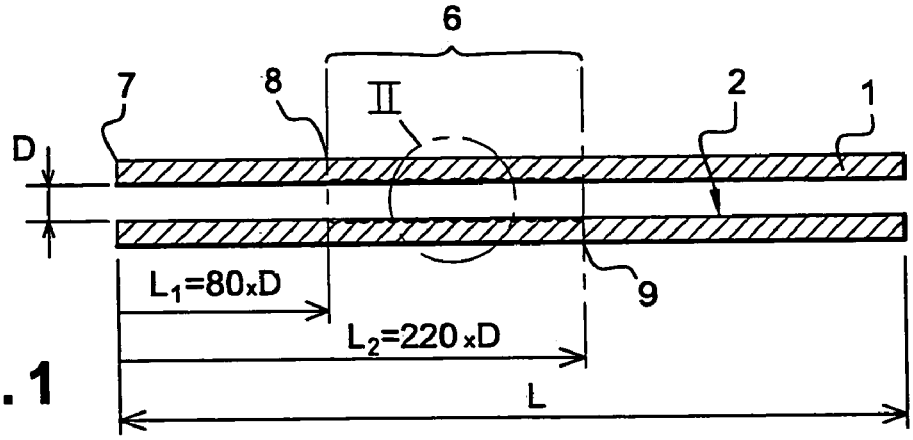
FIG. 1 is a schematic longitudinal cross-section of an exchanger tube according to the invention.

A heat exchanger operating with supercritical $CO_2$ comprises a plurality of tubes as shown in FIG. 1.

According to the invention the inner surface 2 of this type of tube comprises microstructures that form concave or convex relief.

Figure 2:
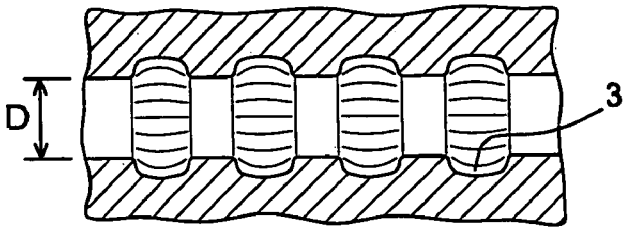
FIG. 2 is a detailed cross-section of zone II of FIG. 1.

In the embodiment shown in FIG. 2 these irregularities take the form of grooves 3 that have been hollowed out circumferentially and are distributed regularly along the zone of the tube where such irregularities are intended to be present.

According to the invention these irregularities are present in a zone 6 that only extends along part of the length of tube 1.

In the form shown in FIG. 1 this zone 6 extends from a first point 8 located at a distance $L_1$ from the inlet 7 of tube 1, with $L_1=80\times D$, where D is the internal diameter of the tube. With reference to FIG. 2, this diameter D is the nominal diameter of the tube without taking hollow zones 3 into consideration.

As shown in FIG. 1, the characteristic zone 6 extends as far as a point 9 located a distance $L_2$ from inlet 7 of the tube. This distance is equivalent to $L_2=200\times D$.

Figure 3:
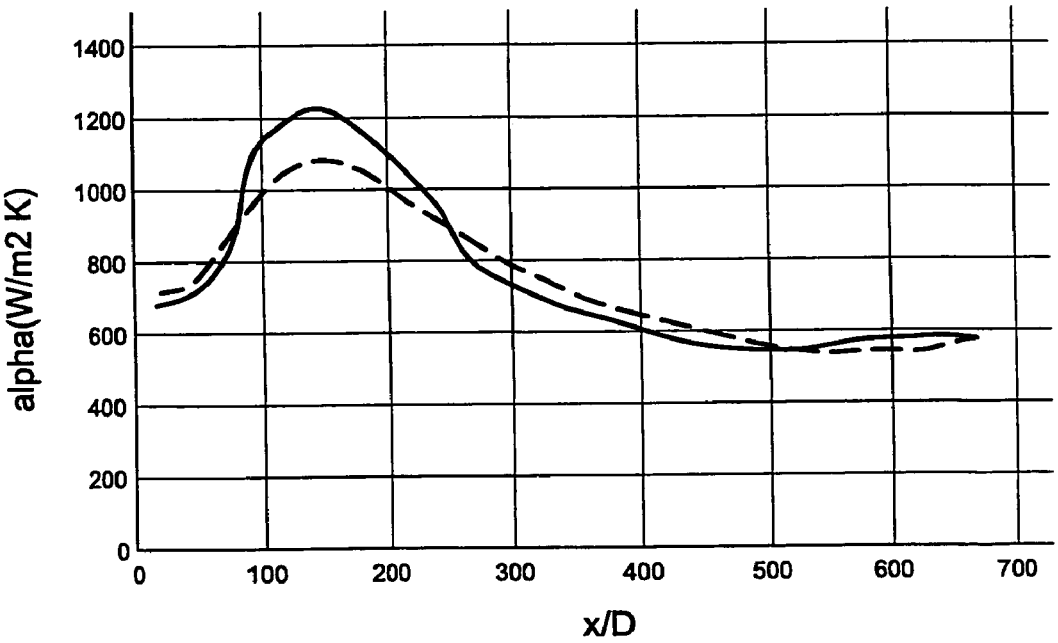
FIG. 3 is a set of two curves showing the variation in the coefficient of heat transfer along the length of a tube, for a smooth tube and a tube according to the invention.

FIG. 3 shows the gains in terms of transfer coefficient obtained by using the tube according to the invention.

The y-axis of these curves is the coefficient of heat transfer in $W/m^2/K$ calculated along the length of the tubular channel. The x-axis is the position on the length of the tube which is given as a relative measurement (x/D) relative to the diameter of the tube.

The dashed curve shows how the coefficient of heat transfer varies in tubes of the prior art, i.e. smooth tubes without relief microstructures. It will be seen that the coefficient of heat transfer reaches a maximum in the tube inlet zone close to the measurement x/d=140. The coefficient then decreases to a value of the order of 550 $W/m^2/K$.

The unbroken curve shows the same variation in the coefficient of heat transfer for a tube according to the invention.

Thus in the zone where the microstructures are present, i.e. between measurements x/D=80 and x/D=220, it will be seen that there is a considerable increase in the coefficient of heat transfer in the zone where the microstructures are present compared with the smooth tube.

On the other hand, once past the zone where the microstructures are located the coefficient of heat transfer is slightly below that of an equivalent smooth tube.

In fact, once beyond measurement x/d=550, the coefficient of heat transfer in a tube according to the invention returns to above the equivalent value for a smooth tube.

As an example, a tube according to the invention was made using a stainless steel base with an internal diameter D of 0.5 mm and a length L of 334 mm. The flow of supercritical $CO_2$ had a mass flow rate of $1.77.10^{-5}$ kg/s at a pressure of 80 bar. The temperature of the $CO_2$ on the tube inlet was 393 K and the temperature of the surface of the tube was 298 K.

The microstructures were present over a zone extending from 80.D, i.e. 40 mm, and 220.D, i.e. 110 mm. The microstructures were rectangular in shape, with a height of 0.05 mm, a width of 0.05 mm, and a pitch of 3.75 mm.

The average transfer coefficient calculated for the overall length of the tube was 853 $W/m^2/K$. This coefficient was calculated using a numerical code for modelling fluid flow such as the FLUENT CFD (Calculations of Fluid Dynamics) software distributed by Fluent France.

This value was compared with the average transfer coefficient calculated for a smooth tube, i.e. one with no microstructure, of the same diameter. The average coefficient in this situation is 739 $W/m^2/K$, an increase of 15.3% due to the characteristic microstructure zone.

It will be seen from the foregoing that the heat exchanger according to the invention has many advantages, particularly that of improving the coefficient of heat transfer and thus the overall performances of the heat exchanger. These performances therefore make it possible to produce heat exchangers that are more compact but offer the same thermal performance characteristics.

The invention claimed is:

1. A heat exchanger comprising a supercritical carbon-dioxide circuit, said circuit comprising a plurality of tubes, wherein at least one section of the tubes comprises surface irregularities present on an inner surface of the tube, said irregularities being located within a zone lying between a first point and a second point, the first point located at a distance of 80 times a diameter of the tube from an inlet of the tube, and the second point located at a distance of 220 times the diameter from the inlet.

2. The heat exchanger as claimed in claim 1, wherein the irregularities (3) lie within a zone (6) lying between points (8) and (9) located at distances from the inlet (7) of the tube of 80 and 220 times the diameter of the tube respectively.

3. The heat exchanger as claimed in claim 1, wherein the tubes have a circular, polygonal or elliptical cross-section.

4. The heat exchanger as claimed in claim 1, wherein the irregularities consist of micro-fins.

5. The heat exchanger as claimed in claim 1, wherein the micro-fins are oriented radially inside the tube.

6. The heat exchanger as claimed in claim 1, wherein the irregularities consist of recesses hollowed out of the inner surface of the tube.

* * * * *